US006536500B2

(12) United States Patent
Neri et al.

(10) Patent No.: US 6,536,500 B2
(45) Date of Patent: Mar. 25, 2003

(54) UNIT FOR FEEDING AND APPLYING SEALS TO SECURITY CASSETTES FOR BANKNOTES

(75) Inventors: Armando Neri, Bologna (IT); Paul Gray, Garland, TX (US)

(73) Assignee: Currency Systems International, Irving, TX (US)

( * ) Notice: Subject to any disclaimer, the term of this patent is extended or adjusted under 35 U.S.C. 154(b) by 154 days.

(21) Appl. No.: 09/779,581

(22) Filed: Feb. 9, 2001

(65) Prior Publication Data

US 2002/0026986 A1 Mar. 7, 2002

(30) Foreign Application Priority Data

Sep. 2, 2000 (IT) ..... BO2000A57

(51) Int. Cl.[7] ..... B65B 7/28

(52) U.S. Cl. ..... 156/556; 156/563; 29/84; 81/15.9; 81/484; 53/138.1; 53/290

(58) Field of Search ..... 156/556, 563; 232/15, 4 R; 81/15.9, 484; 29/804; 53/129.1, 132.1, 134.1, 137.1, 138.1, 138.2, 139.2, 139.5, 264, 290, 291, 317, 387.1, 393; 220/214, 244, 248, 249, 250, 251, 254, 254.1, 254.3; 292/256, 256.5, 259, DIG. 11; 312/216, 222

(56) References Cited

U.S. PATENT DOCUMENTS 5,161,736 A * 11/1992 Roccoberton et al. ..... 232/15
5,533,316 A * 7/1996 Hornsby ..... 53/137.2
5,715,923 A * 2/1998 Dekker et al. ..... 194/206
6,328,355 B1 * 12/2001 Bortz ..... 206/1.5

FOREIGN PATENT DOCUMENTS

| | | | | |
|---|---|---|---|---|
| EP | 1128345 A2 | * | 8/2001 | ..... G07F/9/06 |
| GB | 2039264 A | * | 8/1980 | ..... B65D/43/22 |
| GB | 2105399 A | * | 3/1983 | ..... E05B/65/52 |
| GB | 2291116 A | * | 1/1996 | ..... G07G/1/00 |
| WO | WO 94/05885 | * | 3/1994 | ..... E05G/1/04 |

* cited by examiner

*Primary Examiner*—Mark A. Osele
*Assistant Examiner*—Sue A. Purvis
(74) *Attorney, Agent, or Firm*—Colin P. Cahoon; Carstens, Yee & Cahoon, LLP

(57) ABSTRACT

Banknotes are placed for transportation purposes in cassettes comprising a container and a hinged lid, made secure by applying a seal composed of two parts that can be coupled non-releasably and are provided with latch elements appearing as curved teeth positioned to locate in the holes of lugs associated with the container and with the lid. The seals, loaded into a magazine with the two parts spread, are fed and applied to the cassettes by a unit comprising a clamp assembly with retaining pins designed to pick up the seals from an outlet of the magazine and transfer them to a gripper head presenting a pair of arms by which the two parts are taken up and restrained; the arms are mounted to respective pivots on the gripper head so that when the head is made to assume a final operating position adjacent to the lugs on the cassette, the arms can be rotated toward one another, causing the two parts of the seal to couple together with the curved teeth engaging the holes of the lugs, securing the cassette.

14 Claims, 8 Drawing Sheets

UNIT FOR FEEDING AND APPLYING SEALS TO SECURITY CASSETTES FOR BANKNOTES

BACKGROUND OF THE INVENTION

The present invention relates to a unit for feeding and applying seals to security cassettes for banknotes.

In particular, the invention finds application to advantage in machines by which banknotes are put into relative security cassettes, the art field to which explicit reference is made in the following specification albeit implying no limitation in general scope.

It is well known that banks need to move notable amounts of paper money around on a daily basis, whether central banks by which new banknotes are issued, or trading banks through which the notes are circulated. To this end, banknotes are first sorted into groups and then put into bags or into security cassettes, as mentioned above, for the purposes of handling and transport.

The cassettes are conventional in embodiment, consisting in a container and a lid hinged to the container, of which the lid can be secured in the closed position by a removable fastening mechanism that comprises a catch element associated with a portion of the lid, and a latch and clamp element operating in conjunction with a portion of the container.

To ensure that the cassettes can be transported without the risk of their being broken open and to render them tamperproof, the fastening mechanism incorporates two slots, which, when the mechanism is placed in the operating condition to close the cassette, will accommodate two lugs projecting respectively from the lid and from the container, affording respective through holes positioned to receive the teeth of a seal.

The seal comprises two parts designed to couple together non-releasably, hinged one to another and maneuverable thus from a condition in which the seal is open to a closed condition in which the teeth are inserted into the through holes of the lugs, integral respectively with the lid and with the container, thereby securing the cassette.

In prior art practice the steps of positioning and applying the seal are entirely manual, and this tends to slow down the operating cycle of machines by which the banknotes are put into the cassettes.

The object of the present invention is to provide a unit for feeding and applying seals to security cassettes containing banknotes such as will render the operation of sealing the cassettes completely automatic.

SUMMARY OF THE INVENTION

The stated object is realized in a unit according to the present invention for feeding and applying seals to security cassettes for banknotes, wherein the cassette comprises a container and a lid, the seal is composed of at least two parts affording respective latch means designed to engage relative receiving means afforded both by the container and by the lid, and the parts of the seal are designed to couple together non-releasably and maneuverable from an open condition to a closed condition in which the cassette is secured through the agency of the latch means. The unit disclosed comprises feed means by which the seals are handled in the open condition, means by which the selfsame seals are gripped and positioned alongside the receiving means in an operating position, and means by which the two parts of the seal are coupled together in such a way as to produce the closed condition.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
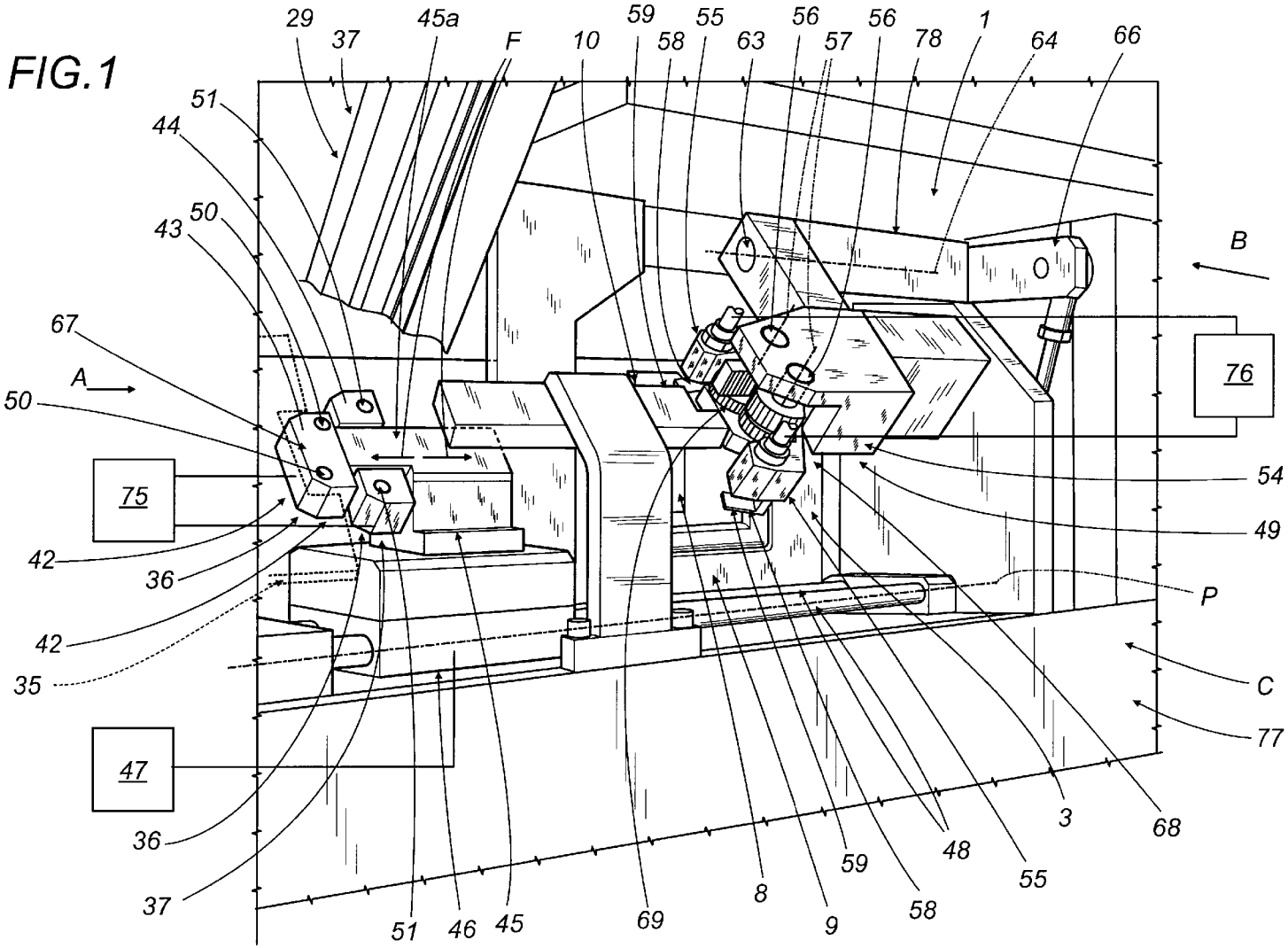
FIG. 1 shows a unit for feeding and applying seals to security cassettes for banknotes, embodied in accordance with the present invention, viewed schematically in perspective and in part as a block diagram, with certain parts omitted for clarity.
Figure 2:
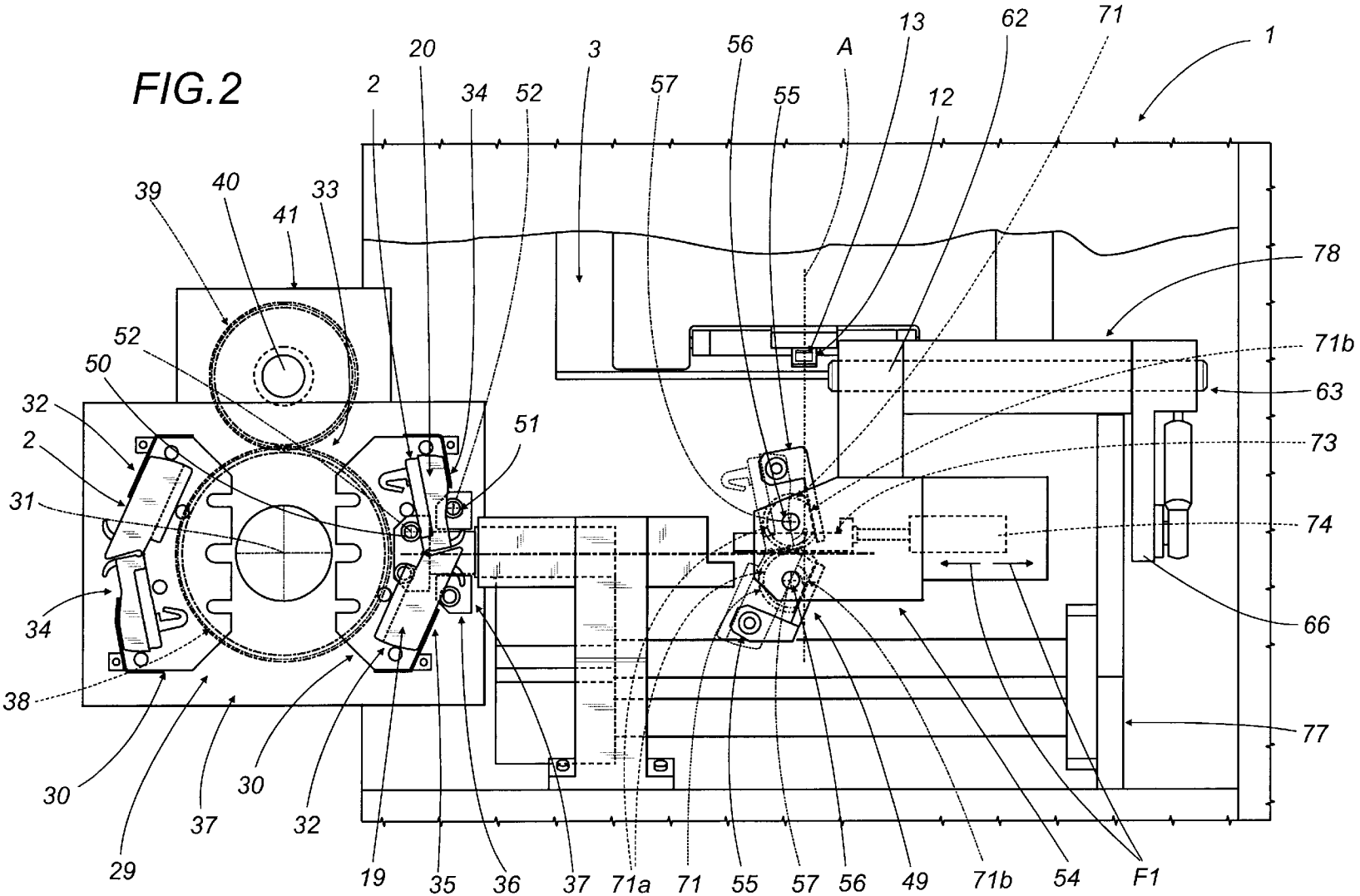
FIG. 2 shows the unit of FIG. 1 in a schematic plan view.
Figure 3:
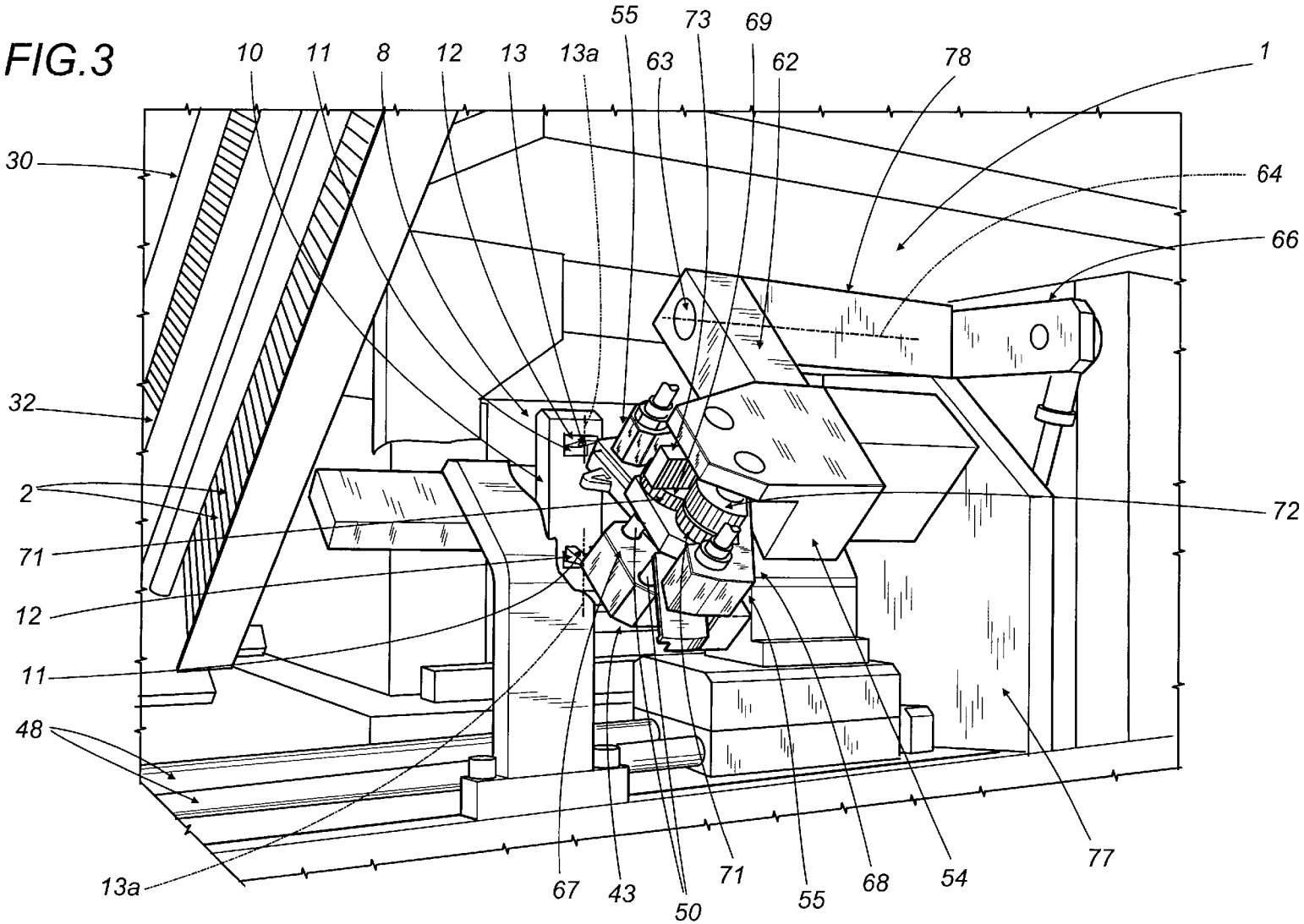
FIG. 3 shows the unit of FIG. 1 in the course of a different operating step.

Referring to FIGS. 1, 2 and 3 of the drawings, 1 denotes a unit, in its entirety, for feeding and applying seals 2 to security cassettes 3 containing banknotes.

Figure 12:
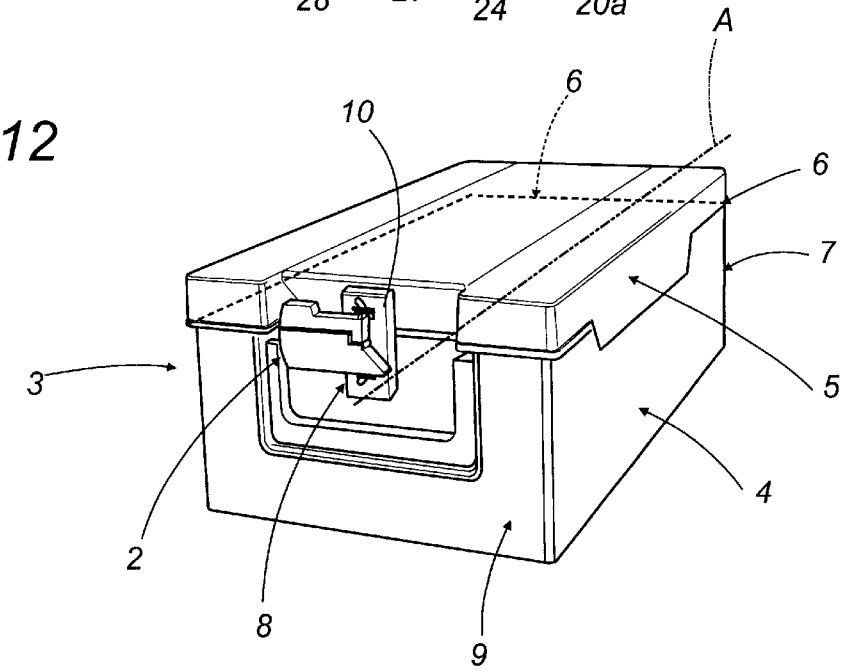
FIG. 12 shows a cassette furnished with the respective seal, viewed in perspective.

As illustrated in FIG. 12, in particular, the single cassette 3 is substantially parallelepiped in appearance, with a predominating longitudinal axis A, and comprises a container 4, also a lid 5 associated pivotably with the container 4 by way of a hinge 6 disposed transversely to the axis A and coinciding with a rear face 7 of the cassette 3.

The lid 5 can be locked in the position which closes the container 4 through the agency of a removable fastening mechanism 8 associated with a front face 9 of the cassette 3 opposite to the rear face 7.

The fastening mechanism 8, which is of familiar embodiment and illustrated in FIGS. 3, 6, 8, 9 and 12, consists essentially in a plate 10 by which the lid 5 is retained in its closed position on the container 4, affording two slots 11 arranged in such a way that when the cassette 3 is closed and the plate 10 in the retaining position, they will accommodate two lugs 12 integral respectively with the lid 5 and with the container 4. The portions of the lugs 12 that project from the plate 10 afford respective through holes 13 with axes 13*a* disposed transversely to the longitudinal axis A of the cassette.

Figure 10:
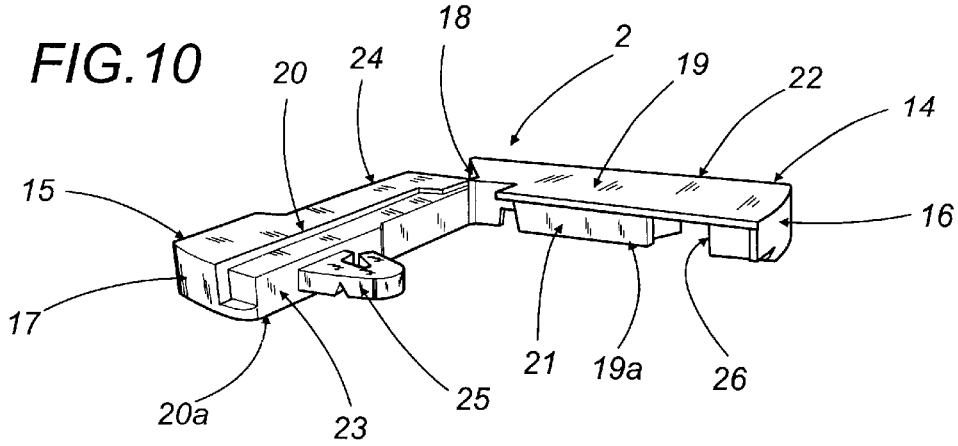
FIGS. 10 and 11 show the seal in perspective.
Figure 11:
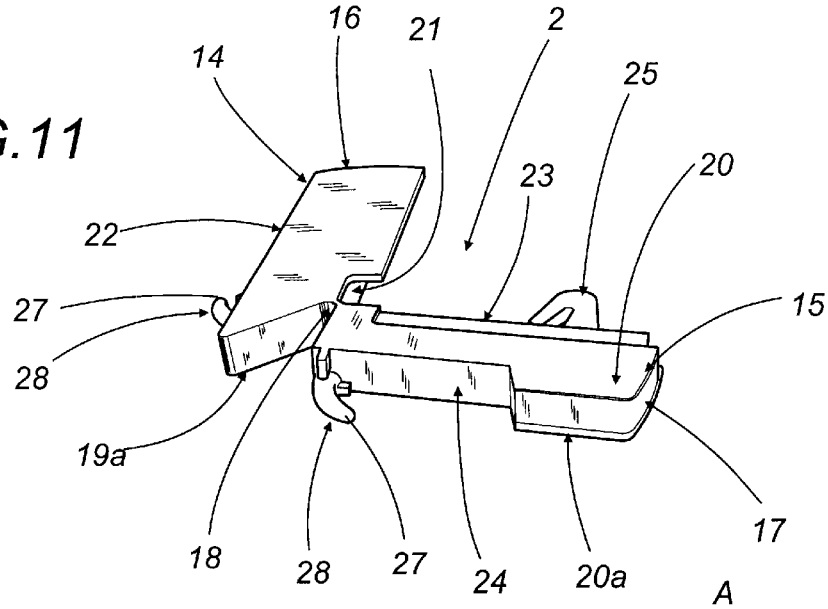

As illustrated to advantage in FIGS. 10 and 11, the single seal 2 comprises two parts 14 and 15 consisting in respective flat box elements 16 and 17 connected one to another by way of a hinge 18.

Each box element 16 and 17 is compassed by a pair of larger side walls extending transversely to the hinge 18, denoted 19 and 19*a* in the case of the one part 14 and denoted 20 and 20*a* in the case of the other part 15. In particular, the walls denoted 19 and 20 lie substantially within one common plane, and the walls denoted 19*a* and 20*a* lie substantially within another common plane.

In addition, one box element 16 presents a first pair of smaller side walls disposed parallel to the hinge 18, constituting the internal flank face 21 and the external flank face 22 of the respective part 14, whilst the other box element 17 presents a second pair of smaller side walls disposed parallel to the hinge 18, likewise constituting the internal flank face 23 and the external flank face 24 of the respective part 15, the internal flank faces 21 and 23 being the two faces that are drawn together when the seal 2 is closed.

One internal flank face 23 presents a hook 25 positioned to snap non-releasably into a socket 26 afforded by the other flank face 21 and thus render the seal 2 unopenable, that is to say, the seal can be opened only by being broken. In addition, the external flank faces 22 and 24 present respective curved teeth 27 positioned near the hinge 18, shown to advantage in the perspective view of FIG. 11, constituting latch means 28 which at the moment of closing the seal 2 are inserted into the respective through holes 13 of the two lugs 12, these in turn constituting receiving means for the latch means 28 associated with the seal 2.

Figure 6:
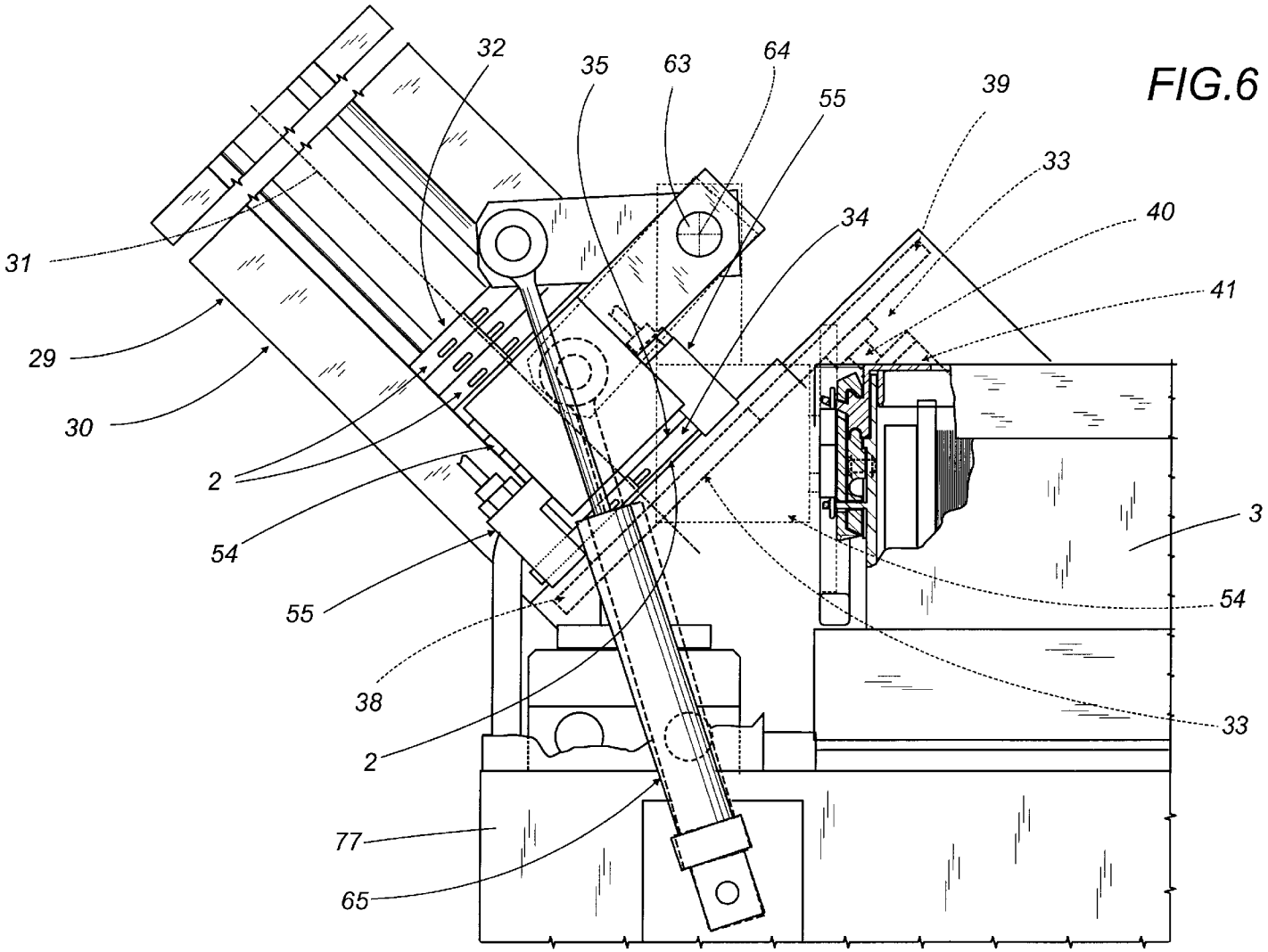
FIG. 6 shows the unit of FIG. 1 in a schematic side elevation from the standpoint denoted B.

The unit 1 comprises a magazine 29 in which the seals 2 are loaded, with a frame 30 of turret type embodiment aligned, as illustrated advantageously in FIG. 6, on a respective longitudinal axis 31 inclined at a predetermined angle from the vertical and affording two stacking channels 32 occupied by the seals 2, diametrically opposed relative to the axis 31 of the frame as illustrated in FIG. 2.

The magazine 29 is equipped with drive means 33, at the base, by which the two stacking channels 32 are set in rotation about the longitudinal axis 31 and placed cyclically with the respective outlet 34 aligned on a station 35 from which the seals 2 are dispensed. Also operating at this same dispensing station 35 are means 36 by which to pick up and transfer the seals 2, and these together with the magazine 29 constitute feed means denoted 37 in their entirety.

Referring to FIGS. 2 and 6, the drive means 33 of the magazine 29 comprise a gear wheel 38 coaxial with the longitudinal axis 31 of the frame 30, and a pinion 39 keyed to the shaft 40 of a motor 41 rigidly associated with the selfsame frame 30.

As discernible in particular from FIGS. 1, 2 and 3, the pickup and transfer means 36 comprise a clamp assembly 42 consisting in first and second jaws 43 and 44 carried by a pedestal 45 and capable of movement one relative to another. In particular, the first jaw 43 is mounted transversely to the end of an arm 45*a* on which the second jaw 44 is carried slidably, capable of movement relative to the first jaw 43 back and forth as indicated by the arrows denoted F, brought about by respective drive means of conventional embodiment, not illustrated. The pedestal 45 is mounted to a slide 46 set in motion by respective pneumatic means also of conventional embodiment, denoted schematically by a block 47, moving on a pair of ways 48 carried by a frame 77 of the unit 1 and aligned along a predetermined longitudinal path P parallel to the direction of the arrows F.

Accordingly, the clamp assembly 42 is capable of movement along the aforementioned path P, carried by the slide 46, between the dispensing station 35, at which the seals 2 are taken up singly from the magazine 29 by the jaws 43 and 44, and a station at which the seal 2 is released ultimately to gripping and positioning means denoted 49 in their entirety.

As indicated in FIGS. 1 to 5, the first jaw 43 presents two pins 50 and the second jaw 44 presents two pins 51. Observing FIGS. 4 and 5 it will be seen that the pins 50 and 51 are slidable along respective axes 52 parallel to the axis 31 of the magazine, set in motion by conventional actuator means denoted 53 in FIGS. 4 and 5.

Figure 5:
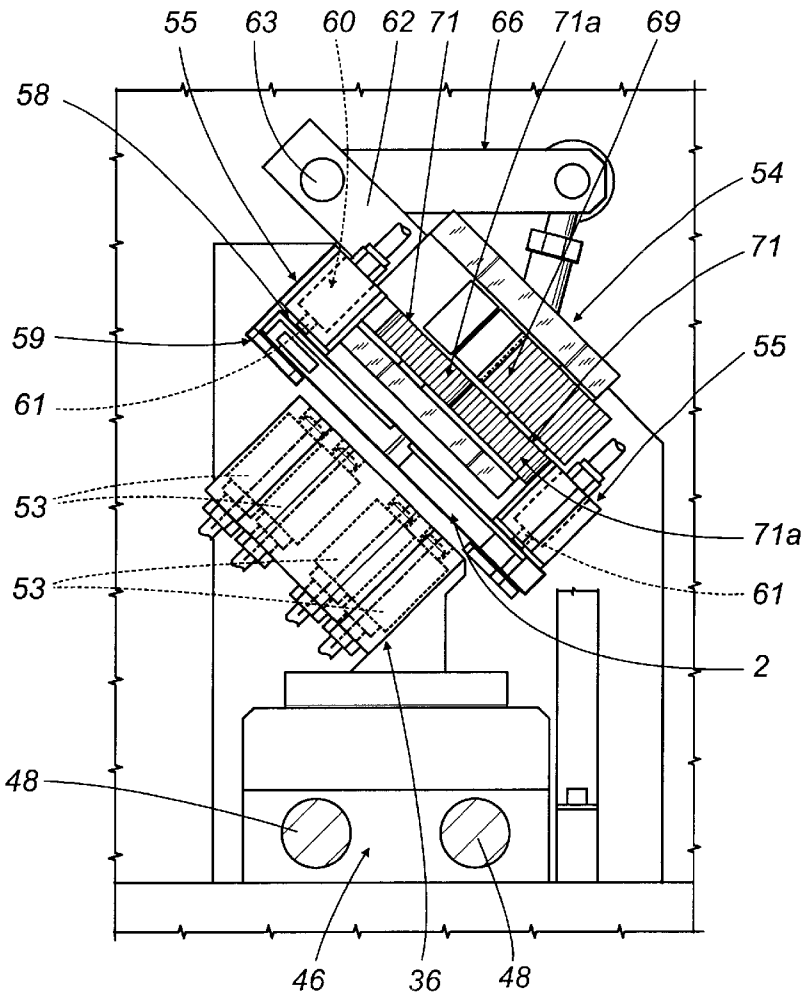
FIGS. 4 and 5 show a detail of FIG. 1 in two different operating steps, viewed schematically in a front elevation from the standpoint denoted A in FIG. 1, with certain parts omitted and others in section.
Figure 4:
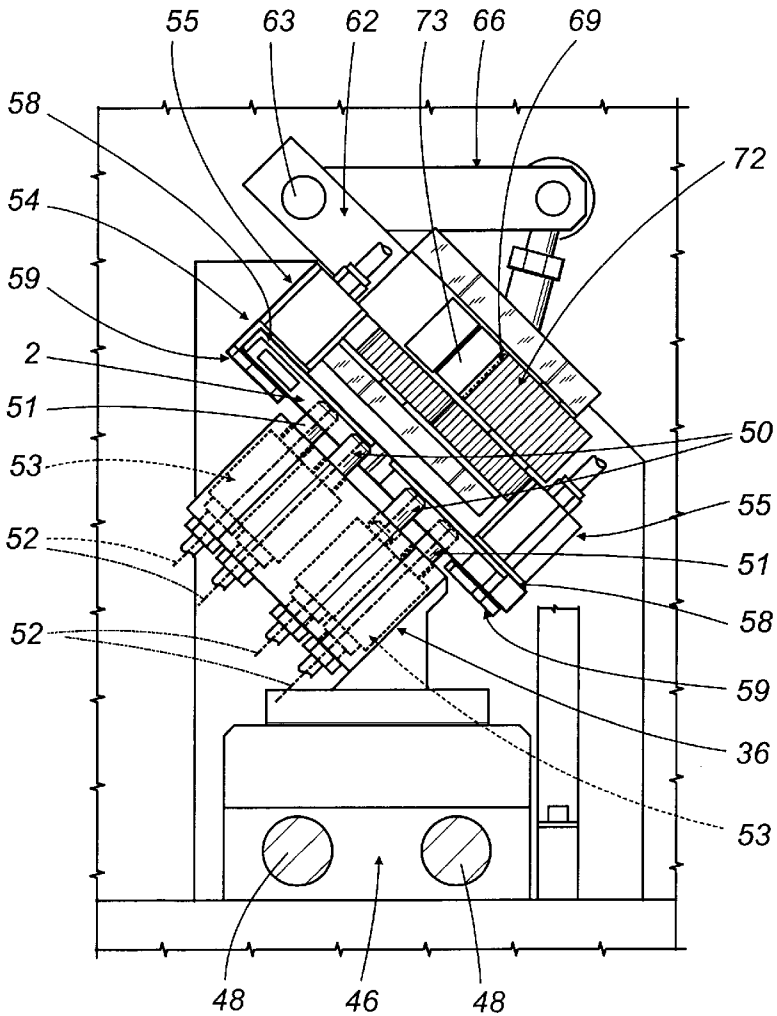

The pins 50 and 51 are reciprocated through the agency of the relative actuator means 53 between a retracted position, illustrated in FIGS. 1 and 5, disposed substantially flush with the face of the clamp assembly 42 in a plane lying at right angles to the axis 31 of the magazine 29, and an extended position proud of the selfsame plane, illustrated in FIGS. 2, 3 and 4.

The gripping and positioning means 49 comprise a gripper head 54 which in turn comprises a pair of arms 55 mounted by way of two first ends associated with a drive mechanism, described in due course, to respective pivots 56 carried by the free end of the head 54 and rotatable about respective axes 57. The free end of each arm 55, opposite to the first end, affords a seat 58 serving to receive one of the two parts 14 and 15 of the seal 2. The single seat 58 presents a U profile and is created by the free end of the arm 55 in combination with an angle element denoted 59. The free end of the arm 55 is equipped with a respective actuator 60, indicated by phantom lines in FIG. 5, of which the relative plunger 61 is designed to penetrate the seat 58 and operate in conjunction with the angle element 59, engaging and pinning the walls 19 and 20 of the box elements 16 and 17 presented by the respective parts 14 and 15 of the single seal 2.

As discernible from FIGS. 3 to 7, the gripper head 54 is mounted to the free end of an arm 62, coupled by its remaining end to a shaft 63 which is carried in a sleeve 78 secured to the frame 77 and can thus be made to rock about an axis 64 extending parallel to the ways 48 of the slide 46, through the agency of a cylinder 65 of which the rod is connected to a lever 66 coupled to the end of the shaft 63 remote from the arm 62. As illustrated to advantage in FIG. 6, the gripper head 54 is made by the cylinder 65 to alternate between a receiving position coinciding with the release position of the clamp assembly 42, as illustrated in FIGS. 3, 4 and 5, in which the seals 2 are taken up, and a final operating position illustrated in FIGS. 6 and 7, in which the gripper head 54 lies adjacent and parallel to the front face 9 of a cassette 3 and the latch means 28 of the seal 2 are offered to the receiving means of the fastening mechanism.

As illustrated in FIGS. 3, 4 and 5, the two pins 50 of the first jaw 43 and the two pins 51 of the second jaw 44 constitute locating elements that can be disposed, at the dispensing station 35 of the magazine 29, in such a way that when extended from the plane occupied by the face of the clamp assembly 42, and as the jaws 43 and 44 are drawn together along the direction of the arrows F, they will engage the opposite flank faces 21 and 22 of the first part 14 and the opposite flank faces 23 and 24 of the second part 15 of the seal 2. More exactly, the clamp assembly 42 and the pins 50 and 51 together constitute first means 67 of gripping the seals 2.

Observing FIGS. 1, 2, 4, 5 and 7 in particular, the gripper head 54, which together with the pair of arms 55 constitutes second gripping means 68, is equipped with respective drive means 69 that serve to operate the arms 55, these in turn constituting means 70 by which the two parts 14 and 15 of the seal 2 are coupled and providing the aforementioned drive mechanism associated with the arms 55.

The drive means 69 comprise a pair of gears 71 keyed to the pivots 56 of the respective arms 55 and engaged in meshing contact one with the other. In particular, as shown in FIG. 2, each gear 71 presents a circular toothed portion 71*a* and a flat portion 71*b* to which the aforementioned first end of the relative arm 55 is fixed, the two toothed portions 71*a* being in constant mesh.

As discernible from FIGS. 1, 3, 4 and 5, the drive means 69 further comprise a toothed sector 72 keyed to one of the two pivots 56 and thus rigidly associated with the relative gear 71. The sector 72 engages in meshing contact with a rack 73 connected to an actuator 74, indicated in FIGS. 2 and 7, by which the selfsame rack 73 can be reciprocated in the direction of the arrow denoted F1 between two limit positions: a first in which the arms 55 are spread as illustrated in FIG. 1, in readiness to receive the seal 2, and a second in which the two parts 14 and 15 of the seal 2 are brought together. On assuming the final operating position in which the single seal 2 is applied, the gripper head 54 lies adjacent to and parallel with the front face 9 of a cassette 3, as illustrated by phantom lines in FIG. 6 and by solid lines in FIG. 7.

In operation, departing from the situation of FIG. 2 in which the outlet 34 of one of the two stacking channels 32 is aligned on the dispensing station 35, the clamp assembly 42 is translated by the slide 46 along the path P up to the selfsame station 35, with the first and second jaws 43 and 44 spread and the respective pins 50 and 51 in the retracted position, below the plane occupied by the active face of the jaws 43 and 44, as illustrated in FIG. 1.

In this way the jaws 43 and 44 take up a position effectively breasted in contact with the downwardly directed walls 19*a* and 20*a* of the seal 2 occupying the outlet 34 of the magazine 29.

At this juncture the two pairs of pins 50 and 51 will be shifted to the extended position by the relative actuator means 53, which are connected to a source of compressed air indicated schematically by a block 75 in FIG. 1, whilst the two jaws 43 and 44 draw together in such a manner as to direct the pins 50 and 51 against both the external flank faces 22 and 24 and the internal flank faces 21 and 23 presented by each part 14 and 15 of the seal 2, with the result that the seal remains clamped.

The slide 46 is now traversed along the ways 48 by the relative pneumatic means 47, following the predetermined path P, to the point of drawing into alignment with the gripper head 54 and gathering the ends of the two parts 14 and 15 of the seal 2 in the seats 58 afforded by the free ends of the two arms 55, currently in the spread position and ready to receive as shown in FIGS. 3 and 4. Once in this position, as illustrated in FIG. 5, the pins 50 and 51 will be distanced from the seal 2 and the plungers 61 made to extend by the relative actuators 60, which are connected to a source of compressed air denoted schematically by a block 76 in FIG. 1, thus clamping the two parts 14 and 15 of the seal 2 against the angle elements 59.

Thereupon, the clamp assembly 42 returns to the dispensing station 35 while the gripper head 54 is rotated about the axis 64 of the shaft 63 by the cylinder 65 in such a way as to direct the head 54 against the front face 9 of the cassette 3, with the result that the seal 2, still held by the two arms 55, is positioned in contact with the plate 10 of the fastening mechanism 8.

Figure 7:
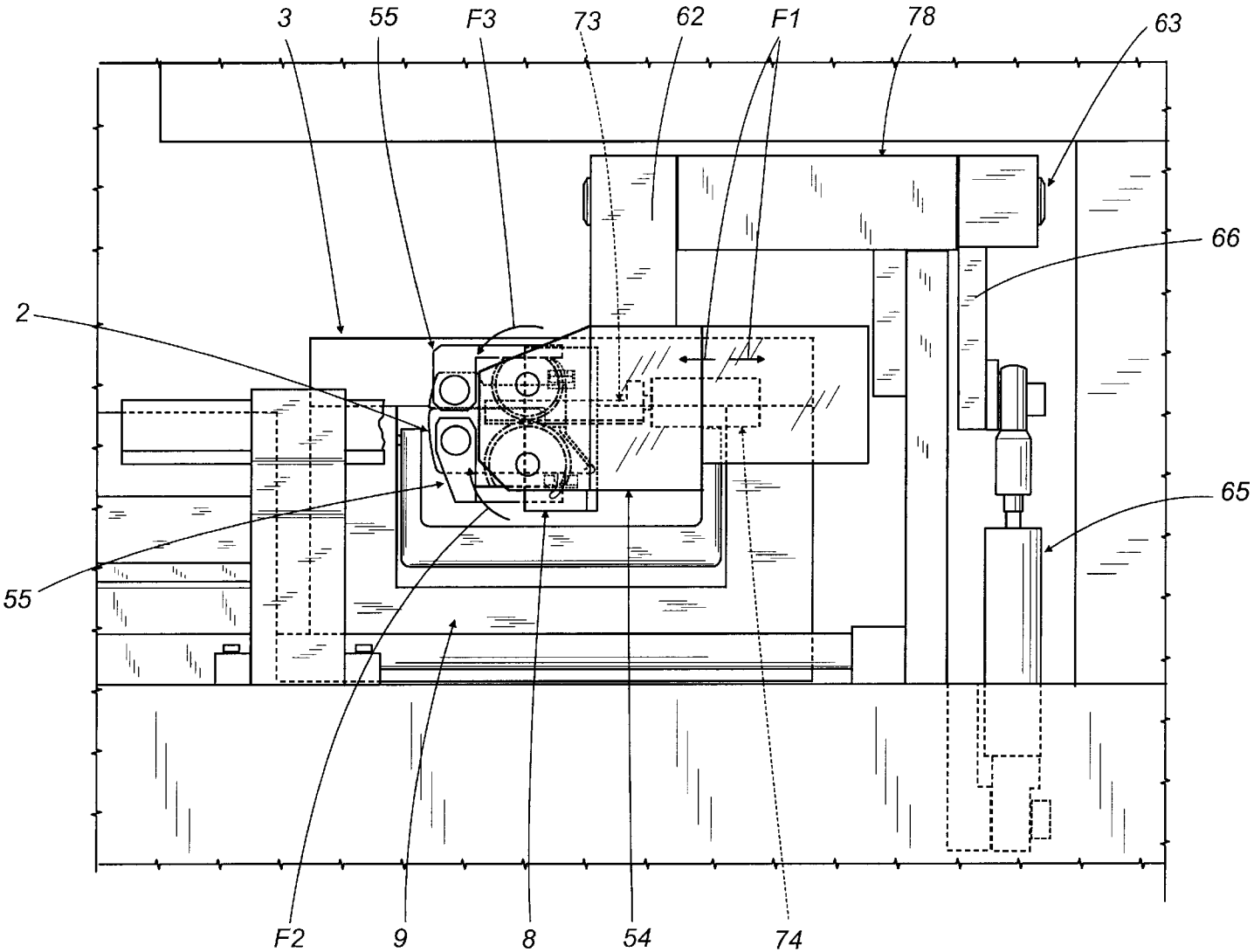
FIG. 7 shows the unit of FIG. 1 in a schematic front elevation from the standpoint denoted C.
Figure 8:
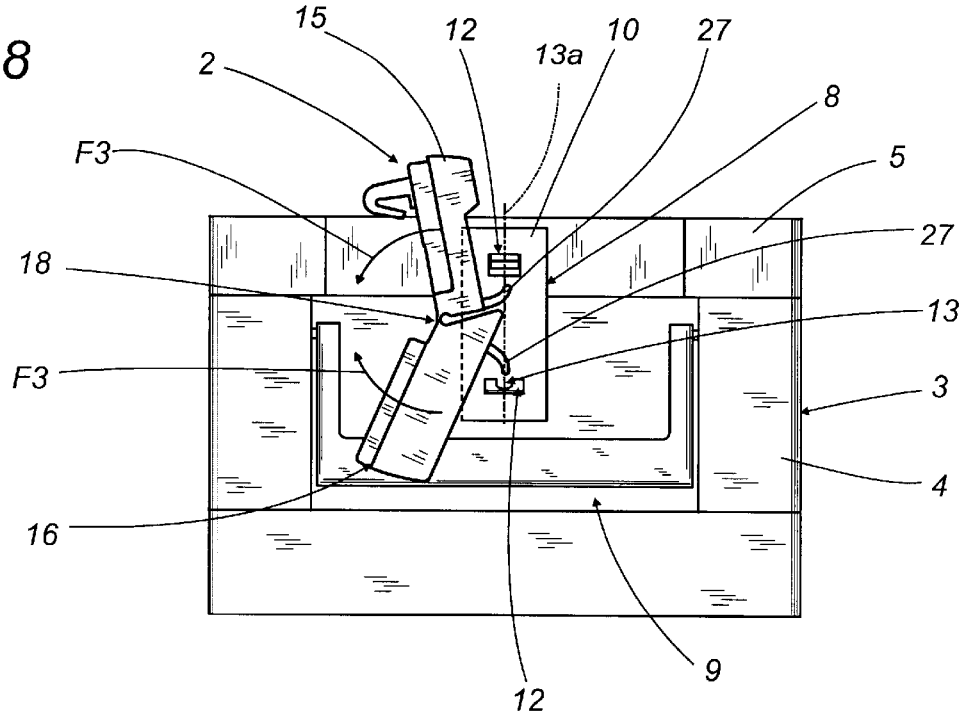
FIGS. 8 and 9 are views taken from the same standpoint as in FIG. 7, showing the front of a cassette with the relative seal in two different operating positions.
Figure 9:
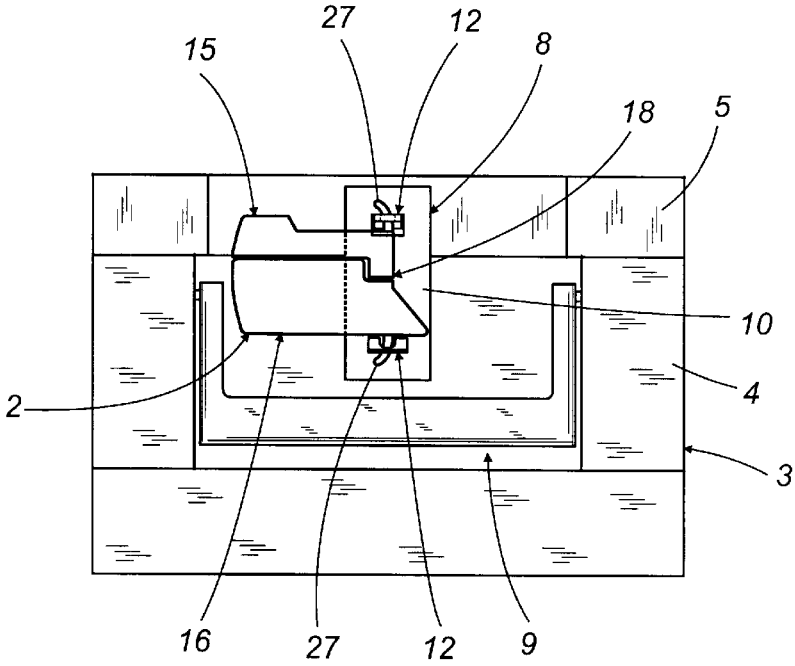

The rack 73 is now caused by the actuator 74 to shift in the direction denoted F1, and the toothed sector 72 with which it engages in mesh induces the pivot 56 and the corresponding gear 71 to rotate in the direction denoted F2, or clockwise as observed in FIG. 7, causing the other meshing gear 71 to rotate in the opposite direction denoted F3. This causes the free ends of the two arms 55 to rotate toward one another, and as a result of the arms 55 thus drawing together, the two parts 14 and 15 of the seal 2 are caused to rotate about the hinge 18, the two internal flank faces 21 and 23 are brought together, the hook 25 locates in the socket 26 and the curved teeth 27 will locate simultaneously in the respective through holes 13 of the lugs 12, as illustrated sequentially in FIGS. 8 and 9.

Following the application of the seal 2 to the cassette 3, the plungers 61 retract, releasing the respective parts 14 and 15 of the seal 2, the two arms 55 resume the spread position and the gripper head 54 is rotated back to the position distanced from the face 9 of the cassette 3, at the end of the aforementioned path P, in readiness to receive a further seal 2 from the clamp assembly 42.

What is claimed is:

1. In a unit for feeding and applying seals to security cassettes for banknotes, wherein the cassette comprises a container and a lid, the seal comprises at least two parts affording respective latch means designed to engage relative receiving means afforded both by the container and by the lid, and the parts of the seal are designed to couple together non-releasably and maneuverable from an open condition to a closed condition in which the cassette is secured through the agency of the latch means, the unit comprising:

feed means by which the seals are handled in the open condition;

means by which the seals are gripped and positioned alongside the receiving means in an operating position;

means by which the two parts of the seal are coupled together in such a way as to bring about the closed condition.

2. A unit as in claim 1, wherein the feed means comprise means by which the seals are picked up from a dispensing station and transferred to the gripping and positioning means.

3. A unit as in claim 2, wherein the pickup and transfer means comprise respective first gripping means designed to clamp the seals by engaging first predetermined portions of the two parts, and the gripping and positioning means comprise second gripping means designed to take up and clamp the seals by engaging second predetermined portions of the two parts.

4. A unit as in claim 3, wherein the first gripping means include a clamp assembly positionable at the station from which the seals are dispensed, capable of movement along a predetermined longitudinal path between the dispensing station and the gripping and positioning means in such a way as to release the seals to the second gripping means, and comprising two jaws capable of movement one relative to another between a non-operative open position and a closed operating position of engagement with the first predetermined portions of the seal.

5. A unit as in claim 4 for feeding and applying a seal of which the two parts are connected one to another by way of a hinge and appear as respective flat box elements compassed by larger side walls occupying respective common planes disposed transversely to the hinge, and smaller side walls or flank faces parallel to the hinge, wherein the jaws of the clamp assembly comprise respective locating elements positionable parallel with the hinge of the seal, when at the dispensing station, in such a manner as to enter into contact with the first predetermined portions of the opposite flank faces presented by the two parts of the seal during the relative movement of the jaws toward the closed operating position.

6. A unit as in claim 5, wherein the locating elements comprise at least two pins associated respectively with each jaw, capable of movement between a position of non-interference with the seal and an operating position of readiness to enter into contact with the first predetermined portions of the opposite flank faces presented by the two parts of the seal.

7. A unit as in claim 4, wherein the locating elements comprise at least two pins associated respectively with each jaw, capable of movement between a position of non-interference with the seal and an operating position of readiness to enter into contact with the first predetermined portions of the opposite flank faces presented by the two parts of the seal.

8. A unit as in claim 4, wherein the second gripping means comprise a gripper head equipped with a pair of arms affording the means by which the two parts of the seal are coupled together, each individual arm mounted pivotably by a first end to the gripper head and presenting a seat at the opposite end in which to receive a respective free end presented by a corresponding flat box element of the seal, each seat equipped with respective means by which to clamp the free end of the relative flat box element.

9. A unit as in claim 8, wherein the second gripping means are capable of oscillating movement about an axis of rotation parallel to the predetermined path between a position in which the seals are received from the clamp assembly, and a final operating position in which the seal is offered to the receiving means associated with the container and the lid of a security cassette.

10. A unit as in claim 9, wherein the gripper head comprises drive means by which the arms are caused to rotate about respective pivot axes, with the second gripping means in the final operating position, between the spread position in which the seal is received, and a closed position in which the two parts of the seal are brought together and coupled thus non-releasably with the respective latch means engaging the respective receiving means.

11. A unit as in claim 8, wherein the gripper head comprises drive means by which the arms are caused to rotate about respective pivot axes, with the second gripping means in the final operating position, between the spread position in which the seal is received, and a closed position in which the two parts of the seal are brought together and coupled thus non-releasably with the respective latch means engaging the respective receiving means.

12. A unit as in claim 2, wherein the feed means comprise a magazine containing the seals and presenting at least one outlet coinciding with the station from which the seals are dispensed to the pickup and transfer means.

13. A unit as in claim 12, wherein the magazine comprises a turret type frame aligned on a longitudinal axis and presenting at least two channels along which the seals are stacked parallel to the longitudinal axis, also drive means by which the frame is rotated about the longitudinal axis so as to position the outlet of each channel cyclically at the station from which the seals are dispensed to the pickup and transfer means.

14. A unit as in claim 13, wherein the longitudinal axis of the magazine is inclined from the vertical by a predetermined angle.

* * * * *